US007041035B1

(12) United States Patent
Stearns et al.

(10) Patent No.: US 7,041,035 B1
(45) Date of Patent: May 9, 2006

(54) EXERCISE METHODS AND APPARATUS WITH ELLIPTICAL FOOT MOTION

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 101 days.

(21) Appl. No.: 10/876,246

(22) Filed: Jun. 23, 2004

Related U.S. Application Data

(60) Provisional application No. 60/483,508, filed on Jun. 26, 2003.

(51) Int. Cl.
*A63B 22/04* (2006.01)

(52) U.S. Cl. ..... 482/52; 482/57; 482/70

(58) Field of Classification Search ..... 482/51–53, 482/57, 70, 79, 80
See application file for complete search history.

(56) References Cited

U.S. PATENT DOCUMENTS 6,612,969 B1 * 9/2003 Eschenbach ..... 482/51
6,802,797 B1 * 10/2004 Maresh ..... 482/57
6,855,094 B1 * 2/2005 Maresh ..... 482/52

* cited by examiner

*Primary Examiner*—Glenn E. Richman

(57) ABSTRACT

An exercise device has left and right rails that are supported on respective pairs of equal length rocker arms, and left and right skates that are movably mounted on respective rails. Left and right cranks move the rails relative to a frame, and move the skates along the rails in a manner that defines adjacent paths of generally elliptical foot motion, while maintaining the foot supports in a fixed orientation relative to the frame.

4 Claims, 2 Drawing Sheets

EXERCISE METHODS AND APPARATUS WITH ELLIPTICAL FOOT MOTION

CROSS-REFERENCE TO RELATED APPLICATION

Figure 1:
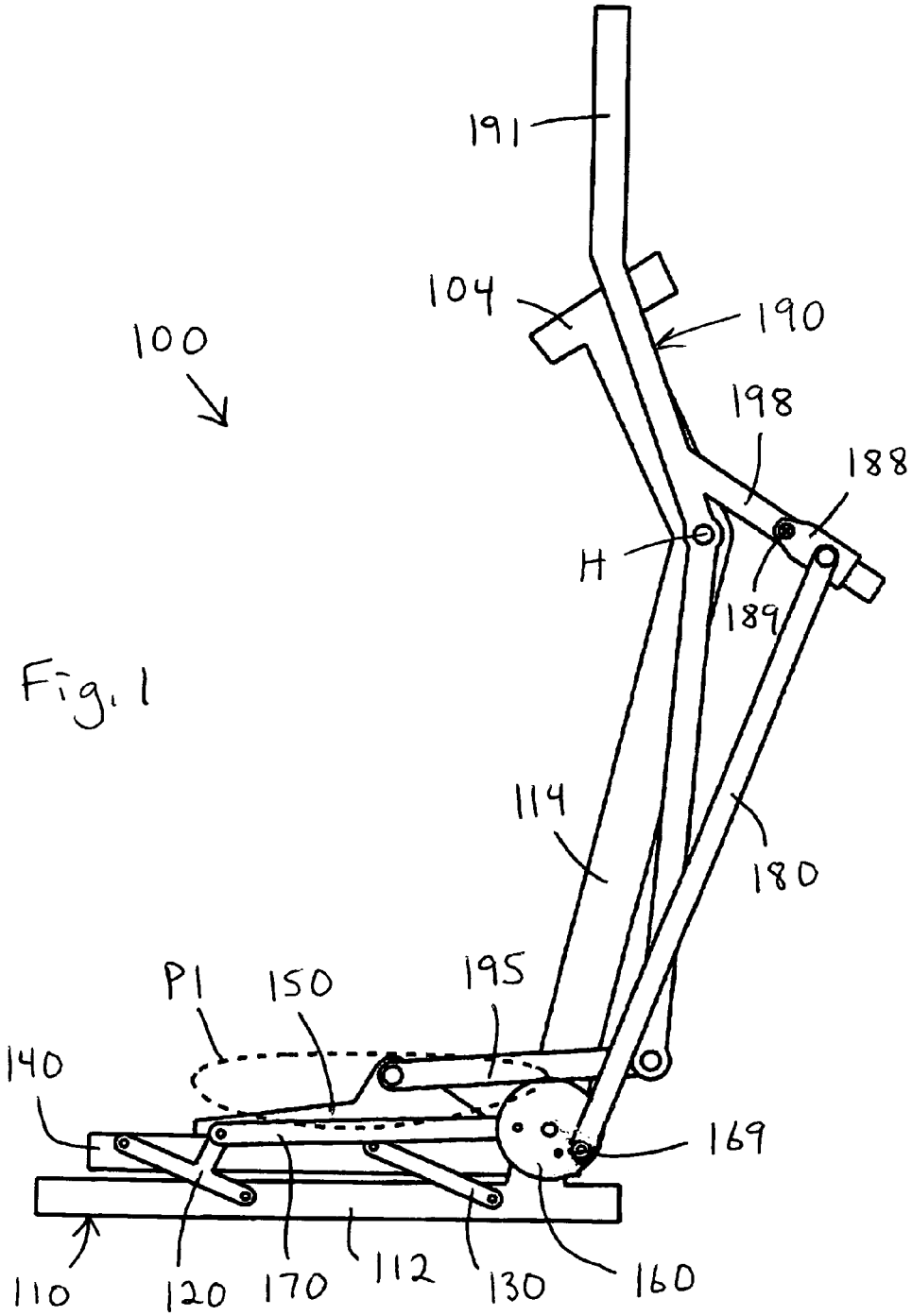

Disclosed herein is material that is entitled to the filing date of U.S. Provisional No. 60/483,508, filed on Jun. 26, 2003.

FIELD OF THE INVENTION

The present invention relates to exercise methods and apparatus, and more specifically, to machines that guide a person's feet through elliptical paths.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses a linkage assembly to convert a relatively simple motion, such as circular, into a relatively more complex motion, such as elliptical. For example, see U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; and U.S. Pat. No. 5,882,281 to Stearns et al.

The foregoing examples of elliptical exercise equipment have foot supports that change orientation during exercise activity. To the contrary, an object of the present invention is to facilitate elliptical foot motion in a manner that maintains the foot supports in a constant orientation.

SUMMARY OF THE INVENTION

Generally speaking, the present invention provides a novel linkage assembly and corresponding exercise apparatus suitable for generating generally elliptical foot motion. The present invention may be described in terms of an exercise apparatus having left and right rails supported by respective left and right pairs of rocker arms pivotally mounted on a frame. A left foot skate is movably mounted on the left rail, and a right foot skate is movably mounted on the right rail. Left and right cranks are connected to respective rails and respective skates in a manner that moves both the rails relative to the frame and the skates relative to respective rails, while maintaining the skates in a constant orientation relative to the frame.

The present invention may also be described in terms of methods for adjusting generally elliptical foot motion on exercise apparatus. For example, on the aforementioned apparatus, each skate is moved relative to a respective rail by a linkage that may be adjusted in various ways to achieve various results. Each such linkage includes a crank, a rocker link, a drawbar interconnected between the crank and the rocker link, and an intermediate link interconnected between the rocker link and the skate. Among other things, the inclination of the foot path may be adjusted by reorienting the drawbar link relative to the crank axis; the length of the foot path may be adjusted by changing the effective crank radius associated with the drawbar link, and/or repositioning the drawbar link relative to the rocker link; and/or the accelerations and decelerations experienced by the skate during the course of an exercise cycle may be adjusted by various combinations of the foregoing adjustments. These sorts of adjustments may be performed on other machines, as well, including similar machines where first and second pairs of cranks are substituted for the pairs of rocker arms.

Many features and advantages of the present invention will become apparent to those skilled in the art from the more detailed description that follows.

BRIEF DESCRIPTION OF THE FIGURE OF THE DRAWING

Figure 2:
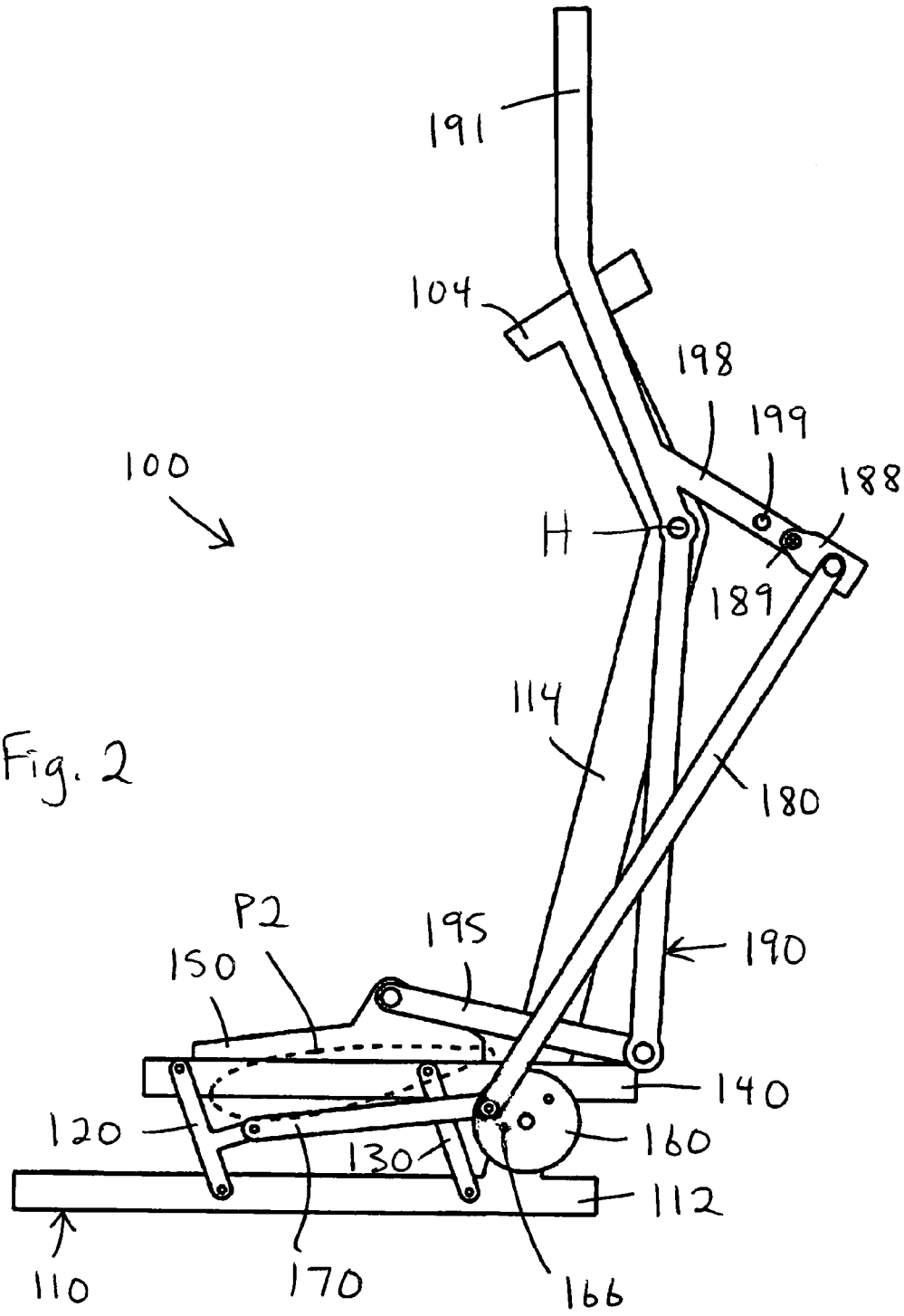

With reference to the Figures of the Drawing, wherein like numerals designate like parts and assemblies throughout the several views, FIG. 1 is a side view of an elliptical motion exercise device constructed according to the principles of the present invention, showing the frame and the near side of a linkage assembly movably mounted on the frame and configured to generate a first elliptical foot path; and FIG. 2 is a side view of the exercise device of FIG. 1, showing the linkage assembly at an alternative point during an exercise cycle and configured to generate a second elliptical foot path.

DETAILED DESCRIPTION OF A PREFERRED EMBODIMENT

A preferred embodiment exercise machine constructed according to the principles of the present invention is designated as 100 in FIGS. 1–2. The exercise machine 100 generally includes a frame. 110; left and right linkage assemblies movably mounted on the frame 110; and a user interface 104 mounted on the frame 110. The interface 104 may be designed to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

The machine 100 is generally symmetrical about a vertical plane extending lengthwise through the center of the frame 110. For ease of illustration, FIGS. 1–2 show only the right side linkage assembly, with the understanding that a similar left side linkage assembly is disposed on the left side of the machine (preferably one hundred and eighty degrees out of phase relative to the right side). Also, to the extent that reference is made to forward or rearward portions of a machine 100, it is to be understood that a person could exercise while facing in either such direction relative to the disclosed linkage assembly.

The frame 110 includes a floor engaging base 112, and a forward stanchion 114 that extends upward from the base 112 proximate the front end of the frame 110. An upper end of the forward stanchion 114 is configured to support the user interface 104, and may be configured to support additional items, including a water bottle, for example.

Each linkage assembly includes first and second rocker arms 120 and 130 having lower ends that are pivotally connected to respective portions of the frame 110, thereby defining first and second lower pivot axes. Opposite, upper ends of the rocker arms 120 and 130 are pivotally connected to respective portions of respective rails 140, thereby defining respective first and second upper pivot axes. On each side of the machine 100, the distance between the two upper pivot axes is equal to the distance between the two lower pivot axes, and the distance between the two pivot axes associated with the first rocker arm 120 is equal to the distance between the two pivot axes associated with the second rocker arm 130. In other words, the rocker arms 120 and 130 cooperate with respective rails 140 and the frame 110 to define respective four bar linkages having opposing links that remain parallel to one another. As a result of this arrangement, the rails 140 are constrained to move through respective arcuate paths while remaining in a fixed orientation relatively to the frame 110.

On each side of the machine 100, a foot support or skate 150 is movably mounted on a respective rail 140. Rollers or bearings are preferably disposed between each foot support 150 and a respective rail 140 to facilitate a smooth gliding interface therebetween. On the preferred embodiment, for example, each skate 150 has front and rear rollers that are constrained to roll along a track defined by a respective rail 140. In other words, the foot supports 150 are constrained to remain in a fixed orientation relative to respective rails 140, but are moveable along same.

On each side of the machine 100, a crank 160 is rotatably mounted on the frame 110 at or near the forward stanchion 114. Each crank 160 may be described in terms of a first effective crank arm that is pivotally connected to the forward end of a first, generally horizontal drawbar 170, and a second effective crank arm that is pivotally connected to the lower end of a second, generally vertical drawbar 180. For reasons discussed below, a removable fastener 169 (see FIG. 1) is inserted through the second drawbar 180 and one of several holes 166 (see FIG. 2) in the crank 160 to effect the latter pivotal connection.

An opposite, rearward end of each first drawbar 170 is pivotally connected to a portion of a respective four bar linkage that moves relative to the frame 110 (in this case, an intermediate portion of the first rocker arm 120). In other words, the first drawbars 170 link rotation of respective cranks 160 to pivoting of respective rocker arms 120 and 130, and/or may be described as means for moving respective rails 140 relative to the frame 110.

On each side of the machine 100, an opposite, upper end of the second drawbar 180 is pivotally connected to a respective sleeve 188, which in turn, is slidably mounted on a respective bar 198. A detent pin 189 or other suitable fastener is inserted through a hole in the sleeve 188 and into one of several holes 199 (see FIG. 2) in the bar 198 to secure the sleeve 188 in one of several locations along the bar 198. Other adjustment arrangements, including powered actuators, may be substituted for the detent pins 189 without departing from the scope of the present invention.

Each bar 198 is rigidly connected to a respective handlebar rocker link 190 at a distance about a common pivot axis H defined between the handlebar rocker links 190 and the stanchion 114. An upper distal end 191 of each handlebar rocker link 190 is sized and configured for grasping. An opposite, lower distal end of each handlebar rocker link 190 is pivotally connected to the forward end of a respective intermediate link 195. An opposite, rearward end of each intermediate link 195 is pivotally connected to a respective foot support 150. As a result of this arrangement, rotation of the cranks 160 is linked to movement of the foot supports 150 along respective rails 140.

Other means for moving the foot supports 150 along the rails 140 may be substituted for the foregoing arrangement. For example, substitute intermediate links (similar to the links 195) may have forward ends that are directly connected to relatively larger radius cranks (substituted for the cranks 160). Generally speaking, the larger the effective crank radius on this alternative embodiment, the greater the horizontal displacement of the foot supports 150.

When the machine 100 is configured as shown in FIG. 1, the foot supports 150 travel through adjacent, generally elliptical paths designated as P1 (and the foot supports 150 remain parallel to the underlying floor surface at all times). As used herein, the term "elliptical" is intended in a broad sense to describe a closed path having a relatively longer, major axis and a relatively shorter, minor axis (which extends perpendicular to the major axis). When the machine 100 is configured as shown in FIG. 2 (with the sleeve 188 repositioned relative to the bar 198 and the second drawbar 180 repositioned relative to the crank 160), the foot supports 150 travel through adjacent, generally elliptical paths designated as P2 (and the foot supports 150 remain parallel to the underlying floor surface at all times).

The paths P2 are relatively shorter and forwardly inclined as compared to the paths P1. Generally speaking, the length of the foot path decreases in response to an increase in the distance measured perpendicularly from the second drawbar 180 to the pivot axis H. Also, the orientation of the foot path is a function of the phasing between the second drawbar 180 and the first drawbar 170. The arrangement and phasing of each second drawbar 180 is also a factor in generating favorable, arcuate motion of the handles 191 to accompany the elliptical foot motion.

Another advantage of the machine 100 is that both the footprint of the machine 100 and the space needed for its operation are relatively small in comparison to the available stride length. The machine 100 may also be considered advantageous to the extent that the stride length is not limited by the diameter or stroke of the cranks. Yet another desirable feature of the machine 100 is that the foot supports 150 may be positioned in close proximity to one another, thereby accommodating foot motion which may be considered a better approximation of real life activity. In this regard, the opposite side rocker arms 120 and 130 (and associated cranks 160) eliminate the need for a frame supported bearing assembly between the foot supports 150.

The present invention has been described with reference to a preferred embodiment that will enable persons skilled in the art to recognize additional embodiments and/or applications which incorporate the essence of the present invention. Those skilled in the art will also recognize that the preferred embodiment may be modified in various ways without departing from the scope of the present invention. For example, various inertia altering devices, including a flywheel and/or resistance mechanisms may be added to the machine. Also, various linkage arrangements may be used to move the rails relative to the frame and/or the skates relative to the rails. Moreover, such linkage arrangements may be implemented on machines having two pairs of cranks substituted for the two pairs of rocker arms. With the foregoing in mind, the scope of the present invention is to be limited only to the extent of the following claims.

What is claimed is:

1. An exercise device, comprising:

a frame configured to rest on a floor surface;

first and second left rocker arms pivotally mounted on the frame;

a left rail pivotally connected to the left rocker arms to define a left four bar linkage that maintains the left rail in a fixed orientation relative to the frame;

a left foot support movably mounted on the left rail for movement along the left rail without changing orientation relative to the left rail;

first and second right rocker arms pivotally mounted on the frame;

a right rail pivotally connected to the right rocker arms to define a right four bar linkage that maintains the right rail in a fixed orientation relative to the frame;

a right foot support movably mounted on the right rail for movement along the right rail without changing orientation relative to the right rail;

a left crank and a right crank, wherein each said crank is rotatably mounted on the frame;

left and right first moving means interconnected between a respective said crank and a portion of a respective said four bar linkage that moves relative to the frame, for moving a respective said rail relative to the frame; and left and right second moving means interconnected between a respective said crank and a respective said foot support, for moving said foot support relative to a respective said rail.

2. The exercise device of claim 1, wherein each said first moving means includes at least one rigid link pivotally interconnected between a respective said crank and a respective said portion.

3. The exercise device of claim 1, wherein each said second moving means includes at least one rigid link pivotally interconnected between a respective said crank and a respective said foot support.

4. The exercise device of claim 1, wherein each said second moving means includes a means for selectively adjusting a path traversed by a respective said foot support during rotation of a respective said crank.

* * * * *